US009640868B2

(12) United States Patent
Peng et al.

(10) Patent No.: US 9,640,868 B2
(45) Date of Patent: May 2, 2017

(54) WIDEBAND ANTENNA AND WIRELESS COMMUNICATION DEVICE

(71) Applicant: Wistron NeWeb Corporation, Hsinchu (TW)

(72) Inventors: Huang-Tse Peng, Hsinchu (TW); Kuo-Jen Lai, Hsinchu (TW); Wen-Tsan Chung, Hsinchu (TW); Cheng-Feng Li, Hsinchu (TW); Yu-Yi Chu, Hsinchu (TW)

(73) Assignee: Wistron NeWeb Corporation, Hsinchu (TW)

( * ) Notice: Subject to any disclaimer, the term of this patent is extended or adjusted under 35 U.S.C. 154(b) by 154 days.

(21) Appl. No.: 14/464,717

(22) Filed: Aug. 21, 2014

(65) Prior Publication Data

US 2015/0333390 A1 Nov. 19, 2015

(30) Foreign Application Priority Data

May 16, 2014 (TW) ..... 103117361 A

(51) Int. Cl.
*H01Q 1/24* (2006.01)
*H01Q 5/378* (2015.01)
*H01Q 9/30* (2006.01)

(52) U.S. Cl.
CPC ..... *H01Q 5/378* (2015.01); *H01Q 1/243* (2013.01); *H01Q 9/30* (2013.01)

(58) Field of Classification Search
CPC ..... H01Q 1/243; H01Q 1/38; H01Q 9/0421; H01Q 21/28
USPC ..... 343/702, 878, 872, 725
See application file for complete search history.

(56) References Cited

U.S. PATENT DOCUMENTS 7,336,229 B1 * 2/2008 Tseng ..... H01Q 1/2258 343/700 MS
2012/0268328 A1 * 10/2012 Kim ..... H01Q 1/243 343/702
2014/0097997 A1 4/2014 Chang

OTHER PUBLICATIONS

W. Y. Chen and K. L. Wong, "Wideband coupled-fed PIFA for HAC penta-band clamshell mobile phone," Microwave and Optical Technology Letters, vol. 51, No. 10, pp. 2369-2374, Oct. 2009.

* cited by examiner

*Primary Examiner* — Dameon E Levi
*Assistant Examiner* — Collin Dawkins
(74) *Attorney, Agent, or Firm* — Winston Hsu; Scott Margo

(57) ABSTRACT

A wideband antenna includes a first radiator formed as a part of a metal frame for resonating a first signal component of a radio-frequency signal, a second radiator disposed within an area enclosed by the metal frame for resonating a second signal component of the radio-frequency signal, and a feed terminal electrically connected between the second radiator and a ground for feeding the radio-frequency signal, wherein there is a distance between the first and second radiators such that a coupling effect is induced between the first and second radiators, which allows the first signal component being fed from the second radiator into the first radiator via the coupling effect.

6 Claims, 5 Drawing Sheets

WIDEBAND ANTENNA AND WIRELESS COMMUNICATION DEVICE

BACKGROUND OF THE INVENTION

1. Field of the Invention

The present invention relates to a wideband antenna and wireless communication device, and more particularly, to a wideband antenna and wireless communication device utilizing a part of a metal frame as an antenna body to adapt to mechanical design.

2. Description of the Prior Art

An antenna is used for transmitting or receiving radio waves, to communicate or exchange wireless signals. An electronic product with a wireless communication function, such as a laptop, a personal digital assistant (PDA), etc., usually accesses a wireless network through a built-in antenna. Therefore, for facilitating a user to access the wireless communication network, an ideal antenna should have a wide bandwidth and a small size to meet the trend of compact electronic products, so as to integrate the antenna into a portable wireless communication device. In addition, an ideal antenna should cover different frequency bands required for different wireless communication networks.

Most of the portable wireless communication devices utilize a metal housing or a metal frame for decoration and robustness, which may cause decreased antenna gain, narrowed bandwidth or unstable antenna performance due to the metal housing or frame when the antenna is integrated in the portable wireless communication device. In such a situation, a designer not only faces a challenge of the antenna performance but also takes integration between antenna and the metal frame into consideration when integrating the antenna into the portable wireless communication device.

Therefore, how to design a wideband antenna to adapt to a mechanical design of the wireless communication device when integrating the antenna into the portable wireless communication device has become a goal in the industry.

SUMMARY OF THE INVENTION

It is therefore an objective of the present invention to provide a wideband antenna and wireless communication device utilizing a part of metal frame as an antenna body to adapt to mechanical design.

An embodiment of the present invention discloses a wideband antenna including a first radiator formed as a part of a metal frame for resonating a first signal component of a radio-frequency signal, a second radiator disposed within an area enclosed by the metal frame for resonating a second signal component of the radio-frequency signal, and a feed terminal electrically connected between the second radiator and a ground for feeding the radio-frequency signal, wherein there is a distance between the first and second radiators such that a coupling effect is induced between the first and second radiators, which allows the first signal component being fed from the second radiator into the first radiator via the coupling effect.

An embodiment of the present invention further discloses a wireless communication device including a metal frame, an antenna including a first radiator formed as a part of the metal frame for resonating a first signal component of a radio-frequency signal, a second radiator disposed within an area enclosed by the metal frame for resonating a second signal component of the radio-frequency signal, and a feed terminal electrically connected between the second radiator and a ground for feeding the radio-frequency signal, wherein there is a distance between the first and second radiators such that a coupling effect is induced between the first and second radiators, which allows the first signal component being fed from the second radiator into the first radiator via the coupling effect.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
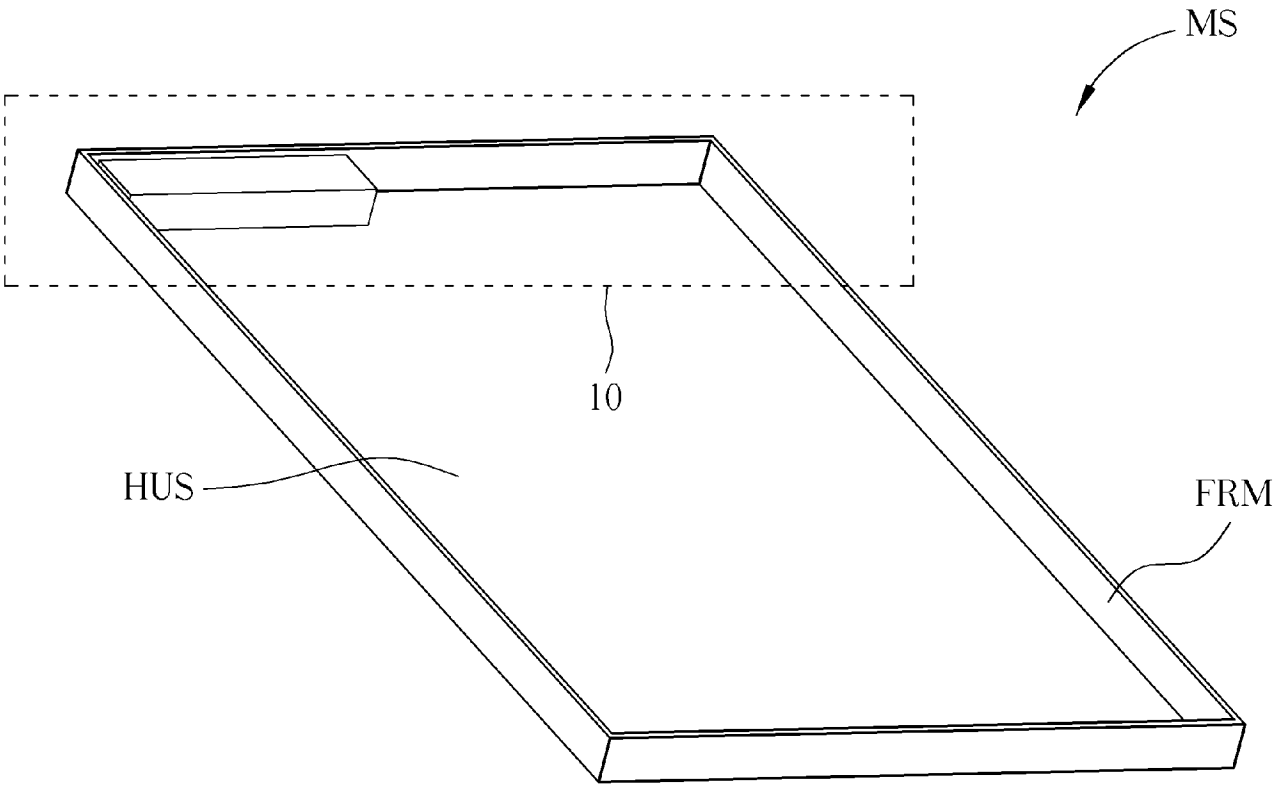
FIG. 1 is a schematic diagram of a wireless communication device according to an embodiment of the present invention.

Please refer to FIG. 1, which is a schematic diagram of a wireless communication device MS according to an embodiment of the present invention. For ease of explanation, the wireless communication device MS is assumed to be a handheld mobile device, to which it is not limited, the wireless communication device MS may be a tablet computer, a laptop, a personal digital assistant or any electronic device having a function of wireless communication. The wireless communication device MS includes a metal frame FRM, a housing HUS and an antenna 10. The metal frame FRM is formed as a part of the housing HUS to completely surround the wireless communication device MS in one piece. A ground GND (not shown in FIG. 1) is formed on the housing HUS to provide grounding. The antenna 10 is used for transmitting and receiving wireless signals to realize wireless communication.

Figure 2:
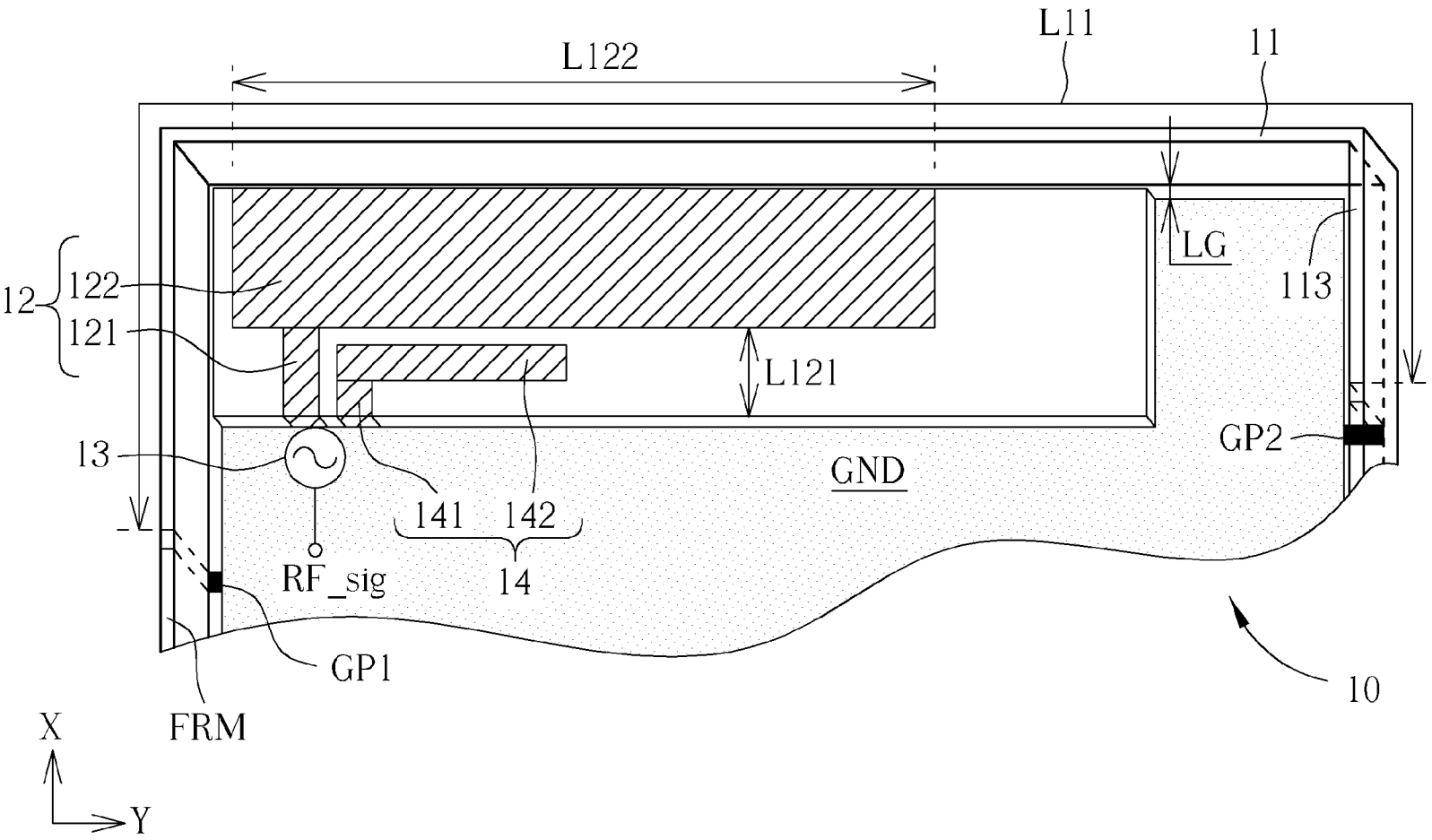
FIG. 2 is a structural diagram of the antenna shown in FIG. 1.

In detail, please refer to FIG. 2, which is a structural diagram of the antenna 10. As shown in FIG. 2, the antenna 10 includes two main radiators 11 and 12, a feed terminal 13 and a parasitic radiator 14. The radiator 11 is used for resonating a low frequency signal component of a radio-frequency signal RF_sig (e.g. 699-960 MHz in this embodiment). The radiator 12 is disposed within an area enclosed by the metal frame FRM for resonating a high frequency signal component of the radio-frequency signal RF_sig (e.g. 1710-2700 MHz in this embodiment). The feed terminal 13 is electrically connected between the radiator 12 and the ground GND for feeding the radio-frequency signal RF_sig. There is a distance LG between the radiators 11 and 12, under the certain distance LG, a coupling effect may be induced between the radiators 11 and 12, which allows the radio-frequency signal RF_sig being fed from the radiator 12 to the radiator 11 or transmitted between the radiators 11 and 12 via the coupling effect.

In operation, when the wireless communication device MS transmits wireless signals, the radio-frequency signal RF_ sig is fed into the feed terminal 13, the high frequency signal component of the radio-frequency signal RF_sig is directly radiated in the air by the radiator 12, and the low frequency signal component of the radio-frequency signal RF_sig is fed from the radiator 12 to the radiator 11 via the coupling effect, such that the radiator 11 may radiate the low frequency signal component in the air. On the other hand, when the wireless communication device MS receives wireless signals, the radiators 11 and 12 respectively induce the low and high frequency signal components from the air, the radiator 11 then transmits the low frequency signal component to the radiator 12 via the coupling effect, and both the low and high frequency signal components are transmitted from the feed terminal 13 to a radio-frequency signal processing module to perform further signal analysis and demodulations. As a result, the antenna 10 may transmit and receive the low and high frequency signal components of the radio-frequency signal RF_sig by the radiators 11 and 12, so as to realize wireless communication.

Noticeably, in appearance, the radiator 11 is a part of the metal frame FRM; or from another view point, the embodiment of the present invention utilizes a part of the metal frame FRM as the main radiator 11 of the antenna 10. Therefore, the embodiment of the present invention may make full use of mechanical parts of the wireless communication device MS, such that the metal frame FRM has multifunction of decoration, robustness, and wireless signal radiation, so as to cleverly integrate the antenna 10 into the wireless communication device.

As can be seen, the embodiment of the present invention utilizes a part of the frame FRM as the main radiator 11 of the antenna 10, and disposes another main radiator 12 within the area enclosed by the metal frame FRM. A coupling effect may be induced between the radiators 11 and 12 when there is the certain distance LG between the radiators 11 and 12, which allows the low frequency signal component of the radio-frequency signal RF_sig being transmitted between the radiators 11 and 12 via the coupling effect. As a result, the metal frame FRM may perform wireless signal radiation, so as to cleverly integrate the antenna 10 into the wireless communication device.

Please note that due to the radiator 11 is the main radiator of the antenna 10, which may be regarded as a part of main body of the antenna 10 but not an additional parasitic radiator, a resonant mode for the low frequency signal component may not be induced if the radiator 11, or the metal frame FRM, is removed from the antenna 10. In other words, the radiator 11, or the metal frame FRM, is an essential part of the antenna 10 to cooperate with the radiator 12, which allows the antenna 10 to induce the resonant mode for the low frequency signal component to perform wireless communication.

Further, an end of the radiator 11 is electrically connected to a ground terminal GP1, another end of the radiator 11 is electrically connected to a ground terminal GP2, wherein the radiator 11 is electrically connected to the ground GND via the ground terminals GP1 and GP2. The radiator 11 has a length L11 extending from the ground terminal GP1 to the ground terminal GP2.

The length L11 is associated with operating frequencies of the low frequency signal component of the radio-frequency signal RF_sig, wherein the length L11 is determined according to locations of the ground terminals GP1 and GP2. Since the length L11 is corresponding to a current path provided by the radiator 11, under a condition that the current path provided by the radiator 11 is corresponding to the operating frequencies or wavelengths of the low frequency signal component, the radiator 11 may induce the resonant mode for the low frequency signal component to radiate the low frequency signal component when the low frequency signal component is fed into the radiator 11. Meanwhile, a return current of the low frequency signal component flowing on the radiator 11 may flow to the ground GND via the ground terminals GP1 and GP2. In such a structure, the radiator 11 provides a loop current path for the low frequency signal component, such that the antenna 10 may be regarded as a coupled-fed loop antenna.

On the other hand, the radiator 12 includes arms 121 and 122. The arm 121 is electrically connected to the feed terminal 13, extending from the feed terminal 13 to the arm 122 along a direction X. The arm 122 is electrically connected to the arm 121, extending from an end of the arm 122 near the arm 121 to another end along a direction Y. The arm 121 has a length L121 extending from the feed terminal 13 to the arm 122. The arm 122 has a length L122 extending from the end of the arm 122 near the arm 121 to another end along the direction Y.

A sum of the length L121 and the length L122 is associated with operating frequencies of the high frequency signal component of the radio-frequency signal RF_sig. Since the sum of the length L121 and L122 is corresponding to a current path provided by the radiator 12, under a condition that the current path provided by the radiator 12 is corresponding to the operating frequencies of the high frequency signal component, the radiator 12 may induce a resonant mode for the high frequency signal component when the high frequency signal component is fed into the radiator 12, which allows the radiator 12 to radiate the high frequency signal component in the air.

In addition, the length L122 is associated with a coupling energy of the low frequency signal component fed from the radiator 12 into the radiator 11 via the coupling effect. Two adjacent surfaces of the radiators 11 and 12 may form parallel capacitor plates, an equivalent capacitance of the parallel capacitor plates increases as the length L122 increases, which decreases a coupling impedance for the low frequency signal component and thus increases the coupling energy of the low frequency signal component which is fed into the radiator 11. On the contrary, the equivalent capacitance of the parallel capacitor plates decreases as the length L122 decreases, which increases the coupling impedance for the low frequency signal component and thus decreases the coupling energy of the low frequency signal component which is fed into the radiator 11.

The parasitic radiator 14 is used for inducing another resonant mode, which widens an operating bandwidth of the antenna 10 (e.g. widen the operating bandwidth for high frequency bands), and also improves a matching between the radiator 12 and the high frequency signal component of the radio-frequency signal RF_sig to reach a wider operating bandwidth. The parasitic radiator 14 includes arms 141 and 142. The arm 141 is electrically connected to the ground GND and extending from the ground GND along the direction X, wherein the arm 121 is disposed between the arm 141 and the radiator 11. The arm 142 is electrically connected to the arm 141, extending along the direction Y, and disposed between the arms 141 and 122.

Figure 3:
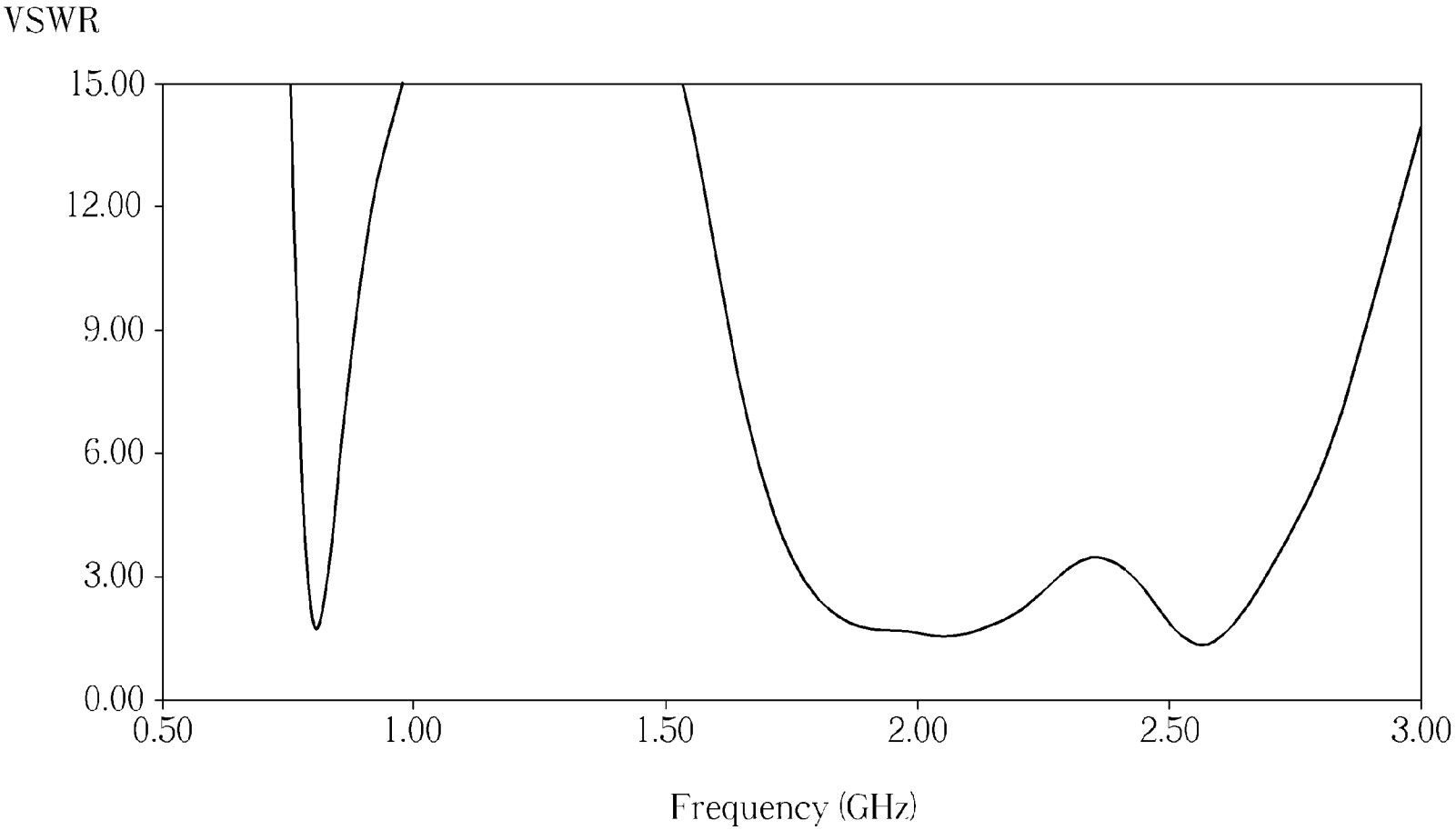
FIG. 3 illustrates voltage standing wave ratio of the antenna shown in FIG. 1.

Please refer to FIG. 3, which illustrates voltage standing wave ratio (VSWR) of the antenna 10. As shown in FIG. 3, the VSWR of the antenna 10 in a low frequency band (e.g. 699-960 MHz in this embodiment) and a high frequency band (e.g. 1710-2700 MHz in this embodiment) is roughly smaller than 3. Therefore, the antenna 10 of the present invention is capable of operating in at least two operating frequency bands to be a wideband antenna. In this embodiment, the radiator 11 provides a longer current path such that the operating frequencies of the low frequency signal component are corresponding to the low frequency band; while the radiator 12 provides a shorter current path such that the operating frequencies of the high frequency signal component are corresponding to the high frequency band.

Please note that the embodiment of the present invention utilizes the metal frame FRM as a part of the main radiator 11 (i.e. main body) of the antenna 10, and the low frequency signal component of the radio-frequency signal RF_sig may be transmitted between the radiators 11 and 12 via the coupling effect. As a result, the metal frame FRM may perform wireless signal radiation, so as to cleverly integrate the antenna 10 into the wireless communication device. Those skilled in the art may make modifications or alterations accordingly, which is not limited in the present embodiment.

For example, sizes associated with the radiators 11 and 12 of the antenna are not limited, a designer may adjust the sizes associated with the radiators 11 and 12 according to required operating bands and frequencies. Specifically, the designer may adjust the length L11 according to the operating frequencies of the low frequency signal component, i.e. adjusting the locations of the ground terminals GP1 and GP2 where the metal frame FRM is connected to the ground, to match the operating frequencies of the low frequency signal component with the current path provided by the radiator 11. The designer may also adjust the sum of the lengths L121 and L122 according to the operating frequencies of the high frequency signal component to match the operating frequencies of the high frequency signal component with the current path provided by the radiator 12.

Relative locations between the radiators 11 and 12 are not limited, the designer may adjust one or both of the distance LG between the radiators 11 and 12 and the length L122 to adjust the coupling energy of the low frequency signal component fed from the radiator 12 into the radiator 11 via the coupling effect.

Or, in this embodiment, the radiator 12 is disposed close to a bend of the radiator 11, which may induce little coupling energy coupled from the arm 122 of the radiator 12 to the bend of the radiator 11 to increase the total coupling energy of the low frequency signal component fed into the radiator 11. Certainly, the designer may move the radiator 12 along the direction Y to adjust the coupling energy of the low frequency signal component fed into the radiator 11 as well.

Moreover, configurations of the parasitic radiator are not limited, parasitic radiators may be added on or removed from the antenna according to practical requirements, or shapes and sizes of the parasitic radiator may be adjusted to adjust an overall matching between the antenna 10 and the radio-frequency signal RF_sig to meet practical requirements.

Figure 4:
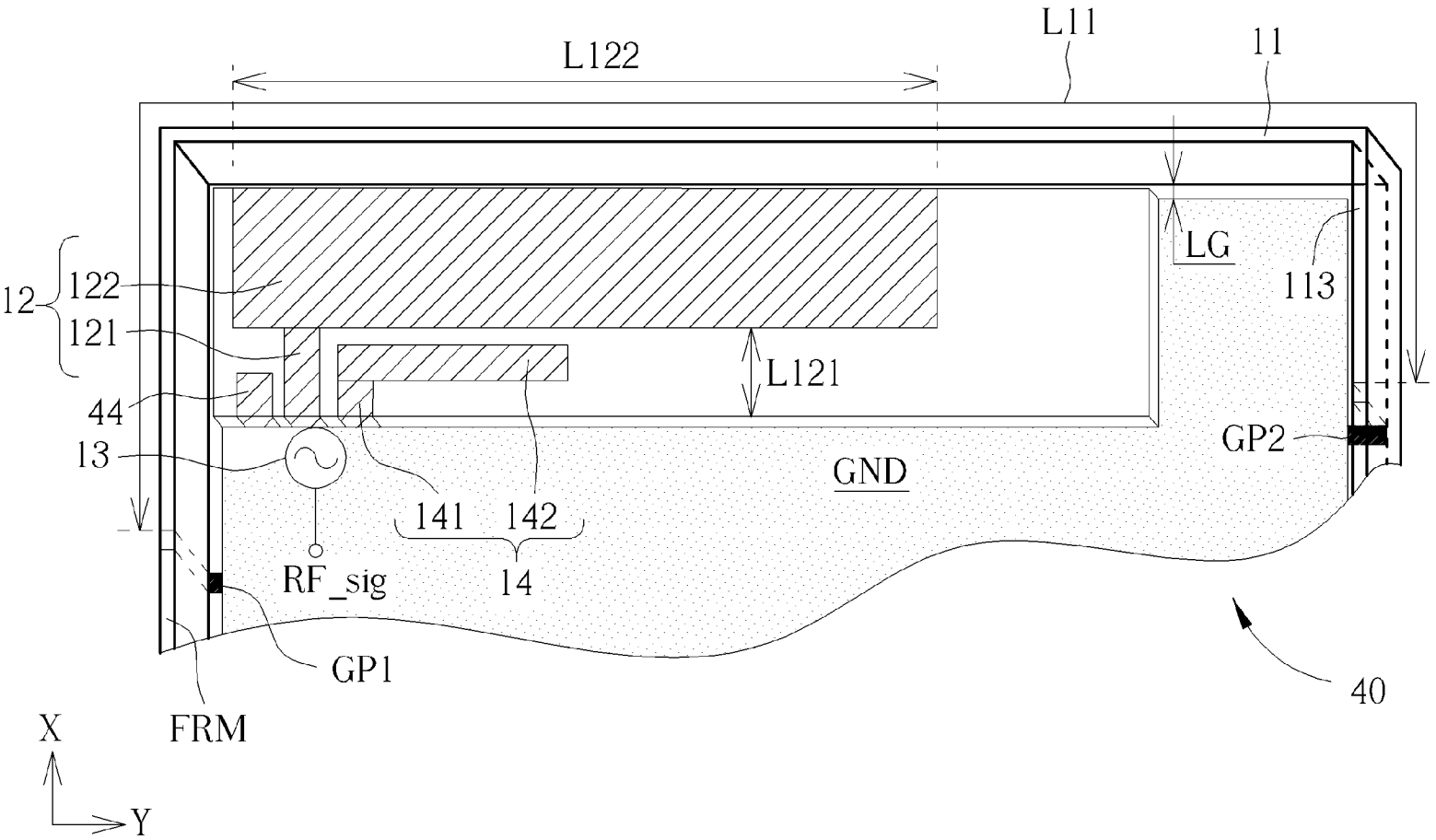
FIG. 4 is a structural diagram of an antenna according to another embodiment of the present invention.

For example, please refer to FIG. 4, which is a structural diagram of an antenna 40 according to another embodiment of the present invention. The antenna 40 further includes a parasitic radiator 44. The parasitic radiator 44 is electrically connected to the ground GND, extending from the ground GND along the direction X, and disposed between the arm 121 and the radiator 11. The parasitic radiator 44 is used for inducing another resonant mode, which widens the bandwidth of the antenna 10, e.g. increase a bandwidth of the high frequency, and improves a matching between the radiator 12 and the high frequency signal component of the radio-frequency signal RF_sig to reach a wider bandwidth.

A shape of the radiator 12 is not limited to a rectangle or a bar shape shown in FIG. 2 and FIG. 4, which may be any regular or irregular shapes. Or, a shape of the metal frame FRM is not limited, which may be any regular shape such as rectangle, circle ellipse or any irregular shapes, as long as there is the certain distance LG between the radiators 11 and 12 to induce the proper coupling energy in between.

Figure 5:
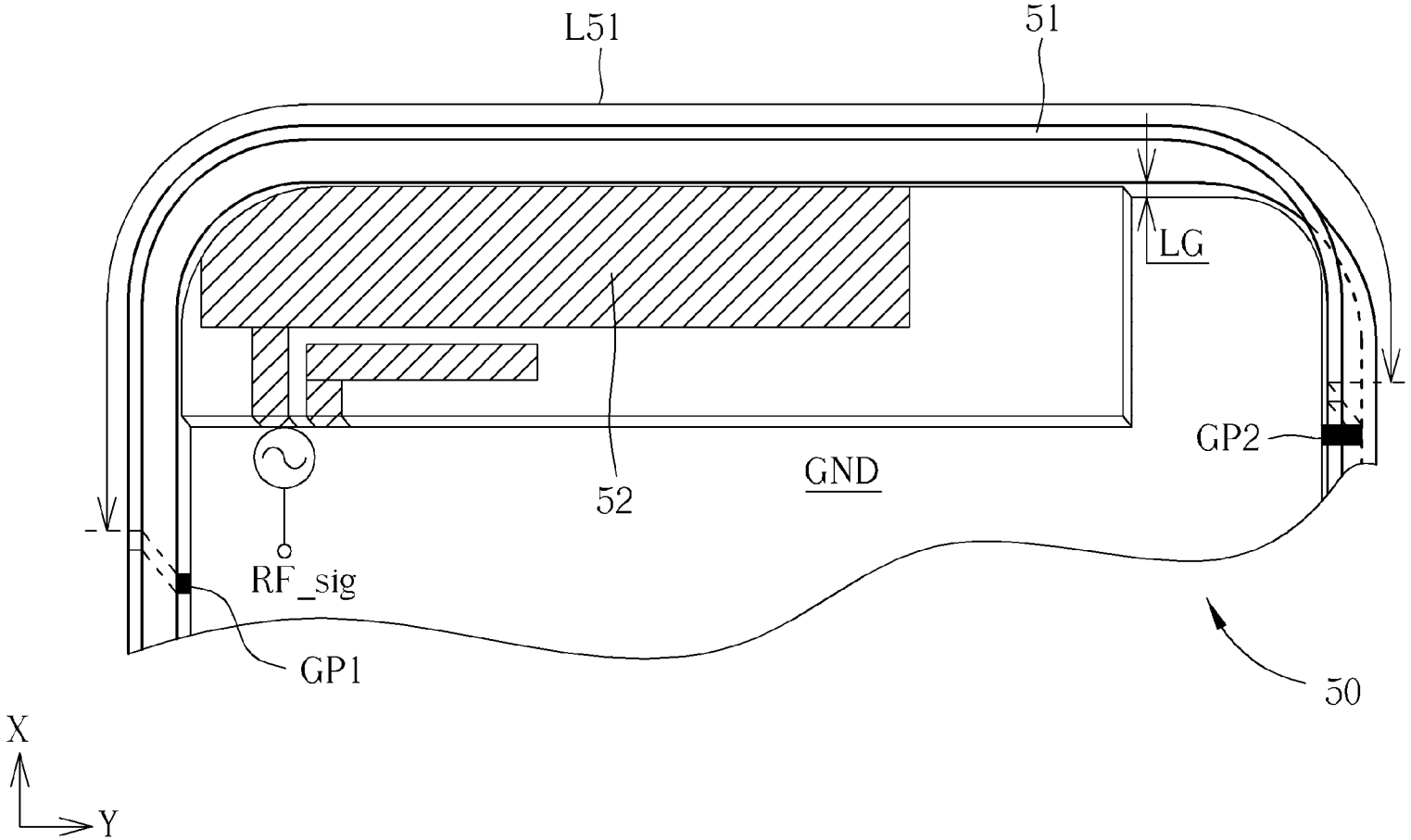
FIG. 5 is a structural diagram of an antenna according to another embodiment of the present invention.

For example, please refer to FIG. 5, which is a structural diagram of an antenna 50 according to another embodiment of the present invention. As shown in FIG. 5, a radiator 51 of the antenna 50, i.e. a part of the metal frame FRM, has two arcs. In such a structure, a radiator 52 of the antenna 50 has an arc close to the arc of the radiator 51, such that the radiators 51 and 52 may be kept parallel with distance LG at the arcs and the adjacent surfaces, thereby the proper coupling energy may be induced between the radiators 51 and 52 to transmit the low frequency signal component. As a result, the radiator 52 may suit a mechanical design of the metal frame FRM or the radiator 51, so as to cleverly integrate the antenna 50 into the wireless communication device. Please note that the designer may adjust the locations of the ground terminals GP1 and GP2 if shapes of the radiator 51 and the radiator 11 shown in FIG. 2 are different, such that a length L51 of the radiator 51, i.e. a current path provided by the radiator 51 matches the low frequency signal component of the radio-frequency signal RF_sig, so as to radiate the low frequency signal component in the air.

To sum up, the various embodiments of the present invention utilizes a part of the metal frame as a main radiator of the antenna, and disposes another main radiator within an area enclosed by the metal frame, such that a coupling effect may be induced between the two main radiators when there is the certain distance in between, which allows the radio-frequency signal being transmitted between the two main radiators via the coupling effect. In addition, the radiator which is a part of the metal frame may provide a loop return current path for the radio-frequency signal, and thus the antenna of the embodiment of the present invention may be regarded as a coupled-fed loop antenna. Therefore, the metal frame may be used for transmitting and receiving wireless signals to cleverly integrate the antenna 10 into the wireless communication device to reach a wider bandwidth and adapt to mechanical design.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A wideband antenna, comprising:

a first radiator formed as a part of a metal frame for resonating a first signal component of a radio-frequency signal;

a second radiator disposed within an area enclosed by the metal frame for resonating a second signal component of the radio-frequency signal, comprising:

a first arm electrically connected to a feed terminal and extending from the feed terminal along a first direction; and a second arm having one end electrically connected to the first arm, another end opened, and extending along a second direction, wherein the first direction is perpendicular to the second direction;

a first parasitic radiator comprising:

a third arm electrically connected to a ground and extending from the ground along the first direction, wherein the first arm is disposed between the third arm and the first radiator; and a fourth arm having one end electrically connected to the third arm, another end opened, and extending from the third arm along the second direction, and disposed between the third arm and the second arm;

a second parasitic radiator electrically connected to the ground, extending from the ground along the first direction, and disposed between the first arm and the first radiator; and the feed terminal electrically connected to the second radiator for feeding the radio-frequency signal;

wherein there is a distance between the first and second radiators such that a coupling effect is induced between the first and second radiators, which allows the first signal component being fed from the second radiator into the first radiator via the coupling effect.

2. The wideband antenna of claim 1, wherein an end of the first radiator is electrically connected to a first ground terminal, and another end of the first radiator is electrically connected to a second ground terminal, wherein the first radiator is coupled to the ground via the first and second ground terminals.

3. The wideband antenna of claim 1, which is a coupled-fed loop antenna.

4. A wireless communication device, comprising:

a metal frame;

an antenna comprising:

a first radiator formed as a part of the metal frame for resonating a first signal component of a radio-frequency signal;

a second radiator disposed within an area enclosed by the metal frame for resonating a second signal component of the radio-frequency signal, comprising:

a first arm electrically connected to a feed terminal and extending from the feed terminal along a first direction; and a second arm having one end electrically connected to the first arm, another end opened, and extending along a second direction, wherein the first direction is perpendicular to the second direction;

a first parasitic radiator comprising:

a third arm electrically connected to a ground and extending from the ground along the first direction, wherein the first arm is disposed between the third arm and the first radiator; and a fourth arm having one end electrically connected to the third arm, another end opened, and extending from the third arm along the second direction, and disposed between the third arm and the second arm;

a second parasitic radiator electrically connected to the ground, extending from the ground along the first direction, and disposed between the first arm and the first radiator; and the feed terminal electrically connected to the second radiator for feeding the radio-frequency signal;

wherein there is a distance between the first and second radiators such that a coupling effect is induced between the first and second radiators, which allows the first signal component being fed from the second radiator into the first radiator via the coupling effect.

5. The wireless communication device of claim 4, wherein an end of the first radiator is electrically connected to a first ground terminal, and another end of the first radiator is electrically connected to a second ground terminal, wherein the first radiator is coupled to the ground via the first and second ground terminals.

6. The wireless communication device of claim 4, wherein the antenna is a coupled-fed loop antenna.

* * * * *